US007925174B2

(12) United States Patent
Nakayama et al.

(10) Patent No.: US 7,925,174 B2
(45) Date of Patent: Apr. 12, 2011

(54) IMAGE FORMING APPARATUS

(75) Inventors: Masayoshi Nakayama, Mito (JP); Shinichi Akatsu, Hitachinaka (JP); Tomohide Takenaka, Mito (JP); Takuma Higa, Hitachinaka (JP)

(73) Assignee: Ricoh Company, Ltd., Tokyo (JP)

( * ) Notice: Subject to any disclaimer, the term of this patent is extended or adjusted under 35 U.S.C. 154(b) by 16 days.

(21) Appl. No.: 12/570,332

(22) Filed: Sep. 30, 2009

(65) Prior Publication Data

US 2010/0080576 A1 Apr. 1, 2010

(30) Foreign Application Priority Data

Oct. 1, 2008 (JP) ..... 2008-256452

(51) Int. Cl.
*G03G 15/08* (2006.01)

(52) U.S. Cl. ..... 399/27; 399/58

(58) Field of Classification Search ..... 399/9, 24, 399/27–30, 49, 53–55, 58, 61, 91, 97
See application file for complete search history.

(56) References Cited

U.S. PATENT DOCUMENTS

2007/0274742 A1 11/2007 Nakayama et al.
2007/0280744 A1 12/2007 Kubo et al.
2008/0019718 A1 1/2008 Akatsu et al.
2008/0199193 A1* 8/2008 Nakazato et al. ..... 399/49
2008/0199205 A1 8/2008 Kubo et al.
2008/0199223 A1 8/2008 Tateyama et al.
2008/0213006 A1 9/2008 Nakayama et al.
2008/0247786 A1 10/2008 Nakayama et al.
2009/0103954 A1 4/2009 Nakayama et al.
2009/0324267 A1* 12/2009 Yoshida et al. ..... 399/49

FOREIGN PATENT DOCUMENTS

JP 2006-194955 7/2006

* cited by examiner

*Primary Examiner* — Hoan Tran
(74) *Attorney, Agent, or Firm* — Oblon, Spivak, McClelland, Maier & Neustadt, L.L.P.

(57) ABSTRACT

An image forming apparatus includes a latent image carrier, a developing unit to develop a latent image on the image carrier with developer including toner and carrier, a developer bearing member, a first detector to detect a toner adhesion amount per unit area of a toner image developed by the developing unit, a second detector to detect humidity, and a controller to calculate an index indicating toner chargeability of the carrier based on detection results of the toner adhesion amount obtained by the first detector and perform a given control process based on calculation results thereof and including a data storage unit to store an algorithm to correct the index to a specific value according to a specific humidity, based on detection results of the humidity obtained by the second detector. The controller corrects the index obtained based on the amount of toner adhesion based on the algorithm.

10 Claims, 3 Drawing Sheets

FIG. 6

| ESTIMATION OF INDEX DA (AFTER CORRECTION OF ABSOLUTE HUMIDITY) | 12 OR BELOW | 13 | 14 | 15 | 16 | 17 | 18 | 19 | 20 | 21 | 22 | 23 | 24 | 25 | 26 | 27 | 28 | 29 | 30 | 31 | 32 | 33 OR ABOVE |
|---|---|---|---|---|---|---|---|---|---|---|---|---|---|---|---|---|---|---|---|---|---|---|
| DETERIORATION MODE | SPENT MODE ⟷ PEELED COATING MODE | | | | | | | | | | | | | | | | | | | | | |
| CARRIER SUPPLY TIMING | – | PER 10kp | | | | PER 20kp | | | – | | | | | | | PER 20kp | | | | PER 10kp | | – |
| AMOUNT OF SUPPLIED CARRIER (g) | – | 12 | 10 | 8 | 6 | 4 | 2 | 0 | 0 | 0 | 0 | 0 | 0 | 0 | 0 | 2 | 4 | 6 | 8 | 10 | 12 | – |

FIG. 7

| ESTIMATION OF INDEX DA (AFTER CORRECTION OF ABSOLUTE HUMIDITY) | 12 OR BELOW | 13 | 14 | 15 | 16 | 17 | 18 | 19 | 20 | 21 | 22 | 23 | 24 | 25 | 26 | 27 | 28 | 29 | 30 | 31 | 32 | 33 OR ABOVE |
|---|---|---|---|---|---|---|---|---|---|---|---|---|---|---|---|---|---|---|---|---|---|---|
| DETERIORATION MODE | SPENT MODE ⟷ PEELED COATING MODE | | | | | | | | | | | | | | | | | | | | | |
| WARNING | INDICATION OF DEVELOPER REPLACEMENT | | INDICATION OF DEVELOPER LIFE END | | – | | | | | | | | | | | | | INDICATION OF DEVELOPER LIFE END | | INDICATION OF DEVELOPER REPLACEMENT | | |

IMAGE FORMING APPARATUS

CROSS-REFERENCE TO RELATED APPLICATIONS

The present invention claims priority pursuant to 35 U.S.C. §119 from Japanese Patent Application No. 2008-256452, filed on Oct. 1, 2008 in the Japan Patent Office, which is hereby incorporated by reference herein in its entirety.

BACKGROUND OF THE INVENTION

1. Field of the Invention

Exemplary embodiments of the present invention relates to an image forming apparatus that calculates an index indicative of toner chargeability of carrier in developer and supplies an appropriate amount of carrier to a developing unit based on the calculated index.

2. Discussion of the Related Art

Known image forming apparatus developing units generally develop a latent image with developer consisting essentially of toner particles and carrier particles, in which only the toner particles are consumed during image development. As the concentration of toner in the developer decreases due to toner consumption during image development, fresh toner particles are added to the developer.

In such known developing units, a toner charge amount within the developing unit can be destabilized by toner deterioration caused by mechanical stress repeatedly applied to the developer by agitating the carrier particles inside the developing unit. At this time, a toner charge amount can either decrease or increase, generally depending on what type of images are most often output.

Specifically, with frequent output of images having a high image area ratio, that is, images in which the recorded image area occupies a large proportion of the total surface area of the recording medium, carrier particles can easily be degraded due to a phenomenon that is referred to as "toner spent", in which the toner component gets fixed onto the surface of the carrier particles. The spent carrier particles can reduce toner chargeability that can be developed by frictional contact with the toner particles, and therefore decrease a toner charge amount in the developing unit. If the toner charge amount is too small, the electrostatic adhesion force exerted between the toner and the carrier weakens, resulting in output of defective images due to background contamination caused by adhesion of toner to a non-imaging area of the recording medium. In addition, the interior of an image forming apparatus incorporating the developing unit can be contaminated due to toner scattering.

By contrast, with frequent output of images with a low image area ratio, the carrier particles in the developer can suffer peeled coating, in which a coating film on the surface of the carrier particle is peeled off. Carrier particles with peeled coating encounter or create increased resistance when in frictional contact with the toner, thereby increasing a toner charge amount in the developing unit. If the toner charge amount is too large, an excessive electrostatic adhesion force is exerted between the toner particles and the carrier particles can dilute image density of the formed image, resulting in faint or washed-out images.

In a known image forming apparatus, after a particular development γ based on the image density of a test patch image and the toner density is measured at a given time it is compared with a known initial developer and new carrier or new developer is gradually supplied to a developing unit based on the measurement results. The development γ is defined as a slope of a line representing a relation between a development potential and an amount of toner adhesion per unit area with respect to a toner image, as shown in FIG. 1. The term "development potential" means a difference in potential between the potential of a latent image carried by a latent image carrying member such as a photoconductor and a developing bias that is applied to a developer bearing member such as a developing roller.

The development γ may vary according to the toner concentration in developer. However, if conditions other than the toner concentration are held constant, a relation that is indicated by a predetermined function arises between the degree of the development γ and the toner concentration. Therefore, when the development γ that corresponds to a particular toner concentration is specified and determined based on the function, any deviation from the expected result between the development γ and the toner concentration can be regarded as a change in the toner chargeability due to deterioration of the carrier particles. That is, the development γ may serve as an index that is a value indicating the toner chargeability of a carrier particle.

The above-described known image forming apparatus stores a function confirmed by previous tests in a data storage unit. When the development γ is measured, a stored value for the development γ as given by the stored function for the measured toner concentration is specified. If there is any difference between the specified value and the measured value of the development γ, a certain amount of new carrier or new developer that corresponds to the difference between development γ and the toner concentration is supplied to the developing unit.

The above-described operation of supplying new carrier or developer may result in an overflow of used carrier or developer, that is, an action that a certain amount of used developer that corresponds to the amount of new carrier or developer supplied to the developing unit overflows from the developing unit. The supply and overflow of carrier or developer can change new and used carriers according to degree of carrier deterioration, thereby stabilizing the toner charge amount.

In the measurement of the development γ, respective given toner images are developed under conditions of different development potentials, and amounts of toner adhesion with respect to the respective toner images are detected by a photosensor. Based on the detection results, a slope of a line indicating a relation between the development potential and the amount of toner adhesion is obtained as a development γ.

However, the development γ may vary significantly in accordance with humidity fluctuation as well as carrier deterioration. Therefore, in the above-described known image forming apparatus, when the development γ varies according to the humidity fluctuation, the change can be misinterpreted as carrier deterioration, and such a false detection can make it difficult to ascertain the toner chargeability of carrier accurately.

Not only the development γ that can serve as an index of the toner chargeability but also the toner chargeability itself can vary according to humidity. Therefore, not only when the development γ but also when any parameter is used as an index of the toner chargeability, a problem similar to the above-described problem can occur.

SUMMARY OF THE INVENTION

Exemplary aspects of the present invention have been made in view of the above-described circumstances.

Exemplary aspects of the present invention provide an image forming apparatus that can effectively calculate an index indicative of toner chargeability of carrier in developer and supply an appropriate amount of carrier to a developing unit based on the calculated index.

In one exemplary embodiment, an image forming apparatus includes a latent image carrier to carry a latent image on a surface thereof, a developing unit to develop the latent image with developer including toner and carrier into a toner image, a developer bearing member to carry the developer, a first detector to detect an amount of toner adhesion per unit area of the toner image developed by the developing unit, a second detector to detect humidity, and a controller to calculate an index that indicates toner chargeability of the carrier of the developer contained in the developing unit based on detection results of the amount of toner adhesion obtained by the first detector and perform a given control process based on calculation results thereof and include a data storage unit to store an algorithm to correct the index to a specific value according to a specific humidity, based on detection results of the humidity obtained by the second detector. The controller corrects the index obtained based on the amount of toner adhesion based on the algorithm.

The given control process may include discharging at least carrier contained in the developer and supplying one of new carrier and new developer from a toner supplying unit to the developing unit.

The given control process may include informing a user that carrier needs to be supplied to the developing unit to replace used carrier with new carrier.

The developing unit may include a third detector to detect a toner concentration of the developer contained in the developing unit. The developing unit may develop the latent image formed on the latent image carrier into a visible image by adhering the toner contained in the developer carried on the surface of the developer bearing member to the latent image. The controller may vary a development potential that represents a difference between a latent image potential of the latent image carrier and a potential of the developer bearing member and form a given toner image under different development potential conditions, obtain a slope of a line indicating a relation between the amount of toner adhesion to the respective toner images and the development potential that corresponds to respective toner images based on the amount of toner adhesion detected by the first detector and the development potential, and calculate the index based on detection results of the toner concentration obtained by the third detector and the slope of the line.

The controller may calculate the index as $DA=-T(\gamma-b)/(Ts\times a)$, where DA represents a value of the index, $\gamma$ represents the slope, T represents a toner image of the developer contained in the developing unit, Ts represents a fresh toner concentration that is a toner concentration of the developer contained in the developing unit when the developing unit is just replaced with a new unit, a represents a given first constant, and b represents a give second constant.

Further, in one exemplary embodiment, an image forming apparatus includes a latent image carrier to carry a latent image on a surface thereof, a developing unit to develop the latent image with developer including toner and carrier, a developer bearing member to carry the developer, a first detector to detect an amount of toner adhesion per unit area with respect to a toner image developed by the developing unit, a second detector to detect humidity, and a controller to calculate an index that indicates toner chargeability of the carrier of the developer contained in the developing unit based on detection results of the amount of toner adhesion obtained by the first detector and perform a given control process based on calculation results thereof and include a data storage unit to store an algorithm that indicates a relation between the humidity and a normal value of the index. The controller specifies and determines the normal value that corresponds to the detection results of the humidity obtained by the second detector based on the algorithm stored in the data storage unit and performing the given control process based on a difference between the determination results and the calculation results of the index.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 6 is a schematic diagram of a control table stored in the image forming apparatus of FIG. 1 according to Exemplary Embodiment 1; and FIG. 7 is a schematic diagram of a control table stored in an image forming apparatus according to Exemplary Embodiment 2.

DETAILED DESCRIPTION OF THE PREFERRED EMBODIMENTS

Figure 1:
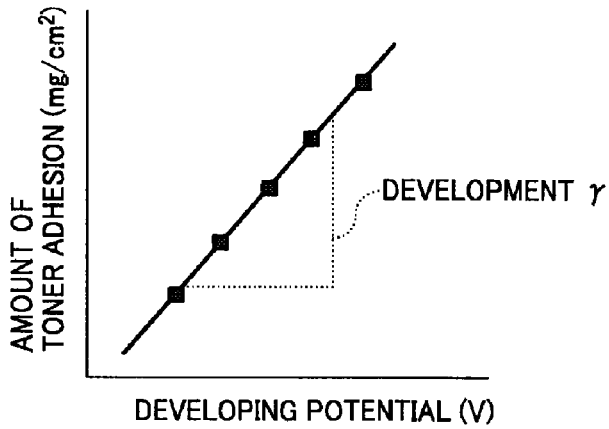
FIG. 1 BACKGROUND ART
FIG. 1 is a graph showing a relation of a development potential and a toner adhesion amount.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would hen be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, exemplary embodiments of the present invention are described.

Now, exemplary embodiments of the present invention are described in detail below with reference to the accompanying drawings.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus. For example, the technique of the present invention is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 2:
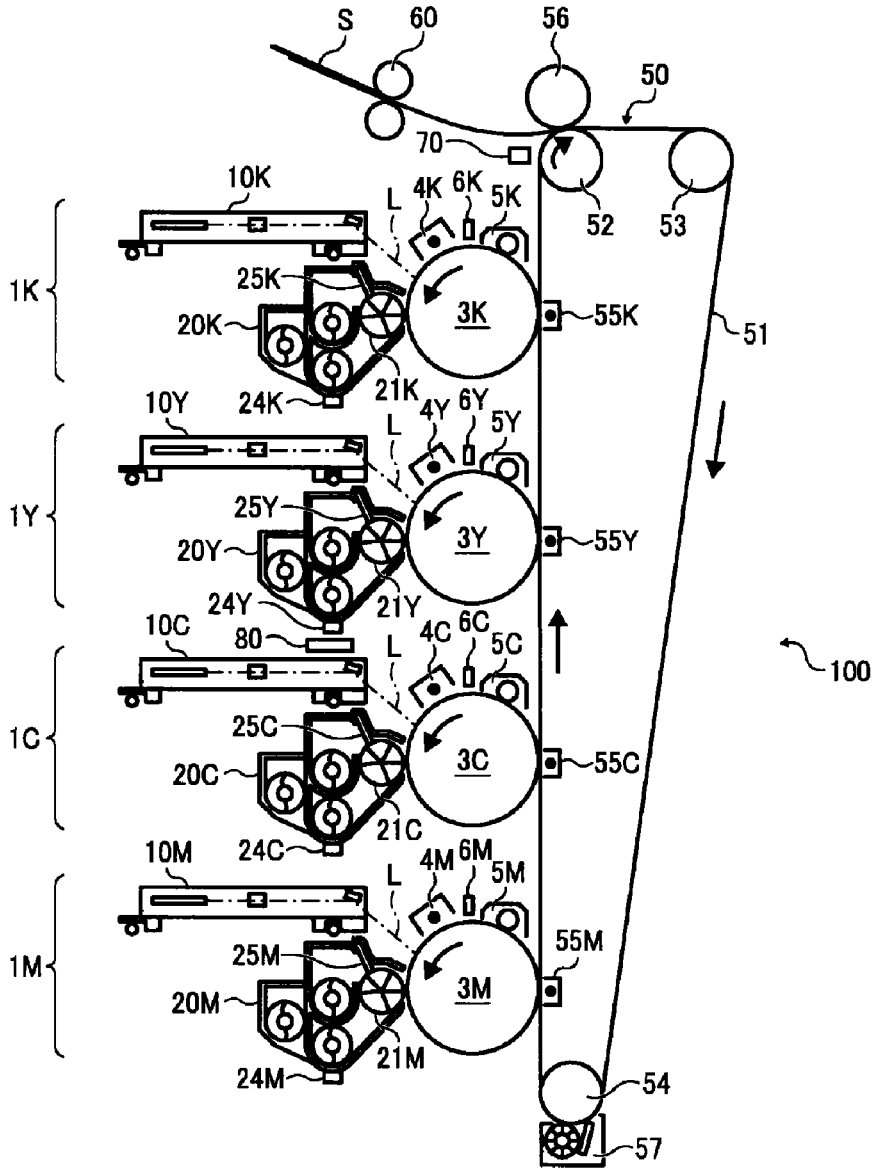
FIG. 2 is a schematic configuration of a main part of an image forming apparatus according to Exemplary Embodiment 1 of the present invention.

FIG. 2 illustrates a schematic configuration of a main part of an image forming apparatus 100 according to Exemplary Embodiment 1 of the present invention.

The image forming apparatus 100 can be any of a copier, a printer, a facsimile machine, a plotter, and a multifunction printer including at least one of copying, printing, scanning, plotter, and facsimile functions. In this non-limiting exemplary embodiment, the image forming apparatus 100 functions as a full-color printing machine for electrophotographically forming a toner image based on image data on a recording medium (e.g., a transfer sheet).

The image forming apparatus 100 includes four image forming units 1M, 1C, 1Y, and 1K and a transfer unit 50.

The four image forming units 1M, 1C, 1Y, and 1K form respective single toner images, which are magenta, cyan, yellow, and black toner images. The respective toner images are formed with four single toner colors, which are magenta, cyan, yellow, and black. Reference symbols "M", "C", "Y", and "K" represent magenta color, cyan color, yellow color, and black color, respectively.

The transfer unit 50 is disposed on a right-hand side of the image forming units 1M, 1C, 1Y, and 1K aligned in a vertical direction in FIG. 2.

The image forming units 1M, 1C, 1Y, and 1K have similar structures and functions, except that respective toners are of different colors, which are yellow, cyan, magenta and black toners, the discussion below will be applied to any of the image forming units 1M, 1C, 1Y, and 1K when the units and components are described without suffixes.

The image forming unit 1 includes a process unit, not shown, an optical writing unit 10 (namely, optical writing units 10M, 10C, 10Y, and 10K), and a developing unit 20 (namely, developing units 20M, 20C, 20Y, and 20K).

The process unit includes a photoconductor 3 (namely, photoconductors 3M, 3C, 3Y, and 3K) and image forming components such as a charging unit 4 (namely, charging units 4M, 4C, 4Y, and 4K), a drum cleaning unit 5 (namely, drum cleaning units 5M, 5C, 5Y, and 5K), and a discharging lamp 6 (namely, discharging lamps 6M, 6C, 6Y, and 6K). The photoconductor 3 serve as a drum-shaped latent image carrier that rotates in a counterclockwise direction in FIG. 2. The charging unit 4, the drum cleaning unit 5, and the discharging lamp 6 are disposed around the photoconductor 3. The process unit holds these components in a common casing to integrally install in the main body of the image forming apparatus 100.

In the image forming apparatus 100, the photoconductor 3 is formed as a tube covered by an organic photoconductor layer. The tube is made of material such as aluminum.

Further, the charging unit 4 uniformly charges the surface of the photoconductor 3 by corona charging to a given polarity (i.e., a negative polarity).

The optical writing unit 10 includes optical components, for example, a light source including laser diodes, a polygon mirror having a regular hexahedron shape, a polygon motor to rotate the polygon mirror, an f-theta lens, lens, reflection mirror, and so forth.

Based on image data that is transmitted from an external personal computer, not shown, the optical writing unit 10 drives the light source including laser diodes and emits a laser light beam L. The laser light beam L is reflected on the surfaces of the polygon mirror and deflected according to the rotation of the polygon mirror before reaching the photoconductor 3. After the above-described operation, the surface of the photoconductor 3 is irradiated by the laser light beam L to form an electrostatic latent image on the photoconductor 3.

The developing unit 20 includes a developing roller 21 (namely, developing rollers 21M, 21C, 21Y, and 21K) and a developer doctor 25 (namely, developer doctors 25M, 25C, 25Y, and 25K).

The developing roller 21 is disposed to expose a part of a circumferential surface thereof from an opening mounted on the casing. The developing roller 21 includes a development sleeve and a magnet roller, not shown. The development sleeve includes a non-magnetic pipe that is rotated by a drive unit, not shown. The magnet roller is included but not rotated with the developing roller 21.

The developing unit 20 contains developer, not shown, which includes magnetic carrier particles and negatively chargeable toner particles.

The developer is agitated and conveyed by three conveyance screws so that the developer can be frictionally charged. Then, the developer is attracted and scooped up to the surface of the development sleeve of the developing roller 21 by a magnetic force of the magnet roller of the developing roller 21. As the development sleeve rotates, the developer doctor 25 regulates the thickness of layer of the developer on the surface of the development sleeve when the developer passes a position opposite the developer doctor 25. Then, the developer is conveyed to a developing region that is located where the developer faces the photoconductor 3.

In the developing region, a development potential effects between the development sleeve to which a developing bias with a negative polarity output by a development bias power source 22 (see FIG. 3) is applied and the electrostatic latent image formed on the photoconductor 3, so that the negatively charged toner can electrically move from the development sleeve to the electrostatic latent image formed on the photoconductor 3.

Further, a non-development potential effects between a uniformly charged portion on the surface of the photoconductor 3 (i.e., a background part) and the development sleeve, so that the negatively charged toner can electrostatically move from the background part to the development sleeve. With the effect of the development potential, the toner included in the developer on the development sleeve is removed from the development sleeve to transfer onto the electrostatic latent image formed on the surface of the photoconductor 3. By so doing, the electrostatic latent image on the photoconductor 3 is developed into a visible toner image.

After the toner is consumed due to the development, the developer is returned to the casing as the development sleeve rotates.

Further, the toner image formed on the photoconductor 3 is transferred onto an intermediate transfer belt 51 of the transfer unit 50, which will be described later.

The developing unit 20 further includes a toner concentration sensor 24 (namely, toner concentration sensors 24M. 24C, 24Y, and 24K). The toner concentration sensor 24 serves as a magnetic permeability sensor to output a voltage according to the magnetic permeability of the developer contained in the developing unit 20. Since the magnetic permeability of the developer is in a good correlation with the toner concentration of the developer, the toner concentration sensor 24 can output a voltage corresponding to the toner concentration.

As an alternative to the magnetic permeability of the developer, the toner concentration sensor 24 can be any detector that detects the toner concentration by receiving reflection from the developer.

The toner concentration sensor 24 is connected to a toner supply controller so that the output voltage of the toner concentration sensor 24 can be transmitted to the toner supply controller.

The toner supply controller includes a storage unit such as a random access memory or RAM to store Vtref data as is (i.e., Vref data of M toner that corresponds to a target value of the output voltage transmitted from the toner concentration sensor 24M), and other Vref data (i.e., Vref data of C toner, Y toner, and K toner that correspond to respective target values of the output values transmitted from the toner concentration sensors 24C, 24Y, and 24K included in the developing units 20C, 20Y, and 20K).

For example, the toner supply controller compares the output voltage transmitted from the toner concentration sensor 24M and the Vtref data for magenta toner, and drives a toner supplying unit for magenta toner for a time period according to the comparison results. According to the above-described operation, the magenta toner is supplied to the developing unit 20M. The above-described toner supply control of the toner supplying unit for magenta toner thus supplies an appropriate amount of magenta toner to the magenta developer in which the toner concentration is decreased after repeated image developing. Therefore, the magenta toner concentration of the magenta developer contained in the developing unit 20M is maintained within a given range.

In the vicinity of the developing unit 20, a carrier supplying unit 23 (see FIG. 3) is disposed. The carrier supplying unit 23 supplies new magnetic carrier or developer to the developing unit 20 according to control signals that is transmitted from a main controller 110, which will be described later. After new carrier or developer is supplied from the carrier supplying unit 23, the volume of the developer in the developing unit 20 increases with the amount of supply of new carrier or developer. As the level of the developer increases, the existing developer contained in the developing unit 20 overflows and is discharged to the outside from an opening mounted on the developing unit 20. Such supply and overflow of carrier or developer can change new and used magnetic carriers in the developing unit 20.

As previously described, the image forming units 1M, 1C, 1Y, and 1K have similar structures and functions, which means that the developing units 20M, 20C, 20Y, and 20K are also similar to each other. Therefore, the above-described change of new and used carriers and/or developers are performed in the developing units 20M, 20C, 20Y, and 20K.

The toner image developed into a visible toner image on the surface of the photoconductor 3 is transferred onto an outer surface of the intermediate transfer belt 51, which will be described later.

Toner that remains on the surface of the photoconductor 3 after image transfer is called residual toner. The residual toner adhering to the surface of the photoconductor 3 is removed by the drum cleaning unit 5.

After the removal of the residual toner, the surface of the photoconductor 3 is electrically discharged by the discharging lamp 6 and uniformly charged by the charging unit 4 for a subsequent image forming operation.

As described above, the image forming units 1M, 1C, 1Y, and 1K that have similar structures and functions to each other can form magenta, cyan, yellow, and black images, respectively, by performing the above-described image forming process.

As previously described, the transfer unit 50 is disposed on the right-hand side from the image forming units 1M, 1C, 1Y, and 1K in FIG. 2 where the image forming units 1, 1C, 1Y, and 1K are aligned along the intermediate transfer belt 51 of the transfer unit 50 in a vertical direction.

The transfer unit 50 includes the intermediate transfer belt 51, a drive roller 52, a tension roller 53, and a driven roller 54. The intermediate transfer belt 51 is spanned around the drive roller 52, the tension roller 53, and the driven roller 54 and is endlessly rotated by the drive roller 52 in a clockwise direction in FIG. 2. The outer surface of the intermediate transfer belt 51 contacts the photoconductors 3M, 3C, 3Y, and 3K as illustrated on the left-hand side of FIG. 2, so that respective primary transfer nip portions can be formed.

Along with the above-described rollers 52, 53, and 54, four transfer chargers 55M, 55C, 55Y, and 55K are disposed facing an inner face of the loop of the intermediate transfer belt 51. The transfer chargers 55M, 55C, 55Y, and 55K are disposed opposite the primary transfer nip portions for magenta, cyan, yellow, and black toner images so as to electrically charge the inner surface of the intermediate transfer belt 51. As the charge is applied, a transfer electric field is formed in the primary transfer nip portions to electrostatically attract the toner particles from the photoconductors 3M, 3C, 3Y, and 3K to the outer surface of the intermediate transfer belt 51.

As an alternative to the transfer charger of corona charging, a transfer roller to which a transfer bias is applied can be used.

The magenta, cyan, yellow, and black toner images formed on the photoconductors 3M, 3C, 3Y, and 3K, respectively, are affected by nip pressure and the transfer electric field in the respective primary transfer nip portions, and are transferred from the photoconductors 3M, 3C, 3Y, and 3K onto the outer surface of the intermediate transfer belt 51 to overlay the respective single color toner images on each other. Thus, a four-color toner image is formed on the intermediate transfer belt 51.

A secondary transfer bias roller 56 is disposed facing the drive roller 52 via the intermediate transfer belt 51 and contacts the outer surface of the intermediate transfer belt 51, which forms a secondary transfer nip portion therebetween. A secondary transfer bias is applied to the secondary transfer bias roller 56 by a voltage applying unit that includes power source and wiring, not shown. A secondary transfer electric field is formed between the secondary transfer bias roller 56 and the drive roller 52 that is grounded.

The full-color toner image formed on the intermediate transfer belt 51 enters the secondary transfer nip portion as the intermediate transfer belt 51 rotates.

The image forming apparatus 100 further includes a sheet feed cassette, not shown, to accommodate a stack of recording sheets that serves as recording media including a recording sheet S that serves as a recording medium. The sheet feed cassette feeds and conveys the recording sheet S placed atop the stack of recording sheets at a given time to a sheet feed path. The recording sheet S that is fed from the sheet feed cassette is sandwiched or held between a pair of registration rollers 60 that is disposed at one end of the sheet feed path.

Both rollers of the pair of registration rollers 60 rotate to hold the recording sheet S fed from the sheet feed cassette and stop as soon as the rollers hold the leading edge of the recording sheet S. The pair of registration rollers 60 then feeds the recording sheet S in synchronization with movement of the four-color toner image formed on the intermediate transfer belt 51.

At the secondary transfer nip portion, the four-color toner image formed on the intermediate transfer belt 51 is secondarily transferred onto the recording sheet S by action of the secondary transfer electric field and the nip pressure. Then the four-color toner image merges with white color of the recording sheet S to form a full-color image.

After secondary image transfer to form the full-color image, the recording sheet S is discharged from the secondary transfer nip portion and then conveyed to a fixing unit, not shown, where the full-color image is fixed to the recording sheet S.

Even after the recording sheet S has passed the secondary transfer nip portion, residual toner may remain on the surface of the intermediate transfer belt 51. A belt cleaning unit 57 is disposed facing the driven roller 54 via the intermediate transfer belt 51 to remove such residual toner from the surface of the intermediate transfer belt 51.

Next, a description is given of an image forming ability adjusting process.

Figure 3:
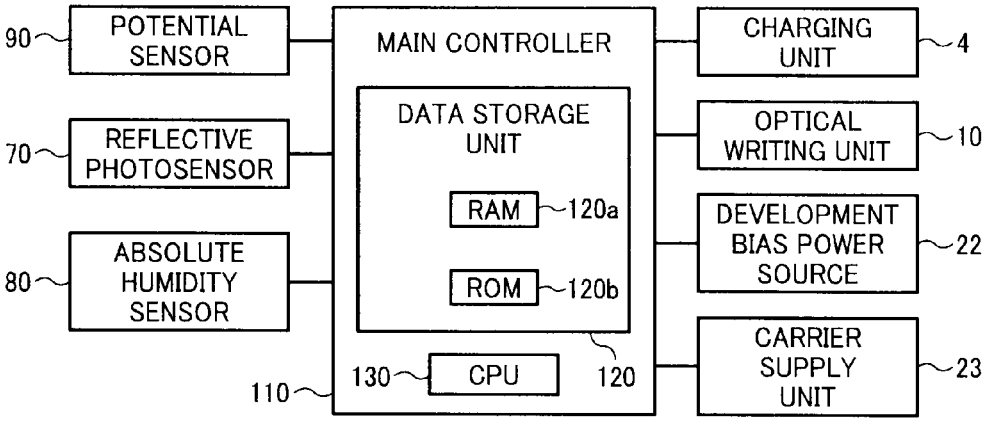
FIG. 3 is a schematic diagram showing a main controller and connected units provided in the image forming apparatus of FIG. 1.

As shown in FIG. 3, the image forming apparatus 100 further includes a main controller 110. The main controller 110 controls units and components of the entire image forming apparatus 100. The main controller 110 includes a central processing unit (CPU) 130, a data storage unit 120 that includes a random access memory (RAM) 120*a* and a read-only memory (ROM) 120*b*, and so forth.

When a print job is started after a long period of waiting time of print instructions issued by a user and each time a predetermined number of prints are output, the main controller 110 performs the image forming ability adjusting process immediately after the power of the image forming apparatus 100 is turned on.

In the image forming ability adjusting process, multiple patch pattern latent images of a predetermined shape are formed on the surface of the photoconductor 3 with different optical writing intensities from each other, and a potential sensor 90 (see FIG. 3) detects each potential of the respective patch patter latent images. Then, the multiple patch pattern latent images are developed into multiple patch pattern toner images under various conditions having different developing biases (voltages applied to the developing roller 21) from each other. Then, a reflective photosensor 70 (see FIG. 3) that serves as a toner adhesion amount detector 70 detects an amount of toner adhesion per unit area of the given patch pattern toner images.

Then, the main controller 110 calculates a development potential that is a potential difference between the latent image potential and the development potential of each of toner images obtained, and calculates a straight line approximation that indicates a relation of the respective development potentials and the amounts of toner adhesion with respect to corresponding patch pattern toner images, where the slope is referred to as "development γ" and the x-intercept is referred to as "development start voltage".

After the development γ (unit: [mg/cm$^2$/kv]) is calculated, the main controller 110 then specifies a development potential that is necessary to obtain a target amount of toner adhesion, based on the development γ, and specifies a photoconductor charge potential Vd, a developing bias Vb, and an optical writing intensity VL, each of which can achieve this development potential by referring to a predetermined potential table. For print jobs that are performed afterwards, a combination of the specified photoconductor charge potential Vd, developing bias Vb, and optical writing intensity VL is employed. The above-described image forming ability adjustment process is performed for magenta, cyan, yellow, and black toner images.

The reflective photosensor 70 can detect an amount of toner adhesion of each patch pattern toner image either on the surface of the photoconductor 3 or on the surface of the intermediate transfer belt 51.

Exemplary Embodiment 1

Next, a description is given of a characteristic configuration of the image forming apparatus 100 according to Exemplary Embodiment 1 of the present invention.

In each of the developing units 20M, 20C, 20Y, and 20K, a toner charge amount Q per weight unit [μC/g] may vary according to a toner concentration of developer. Specifically, as the toner concentration increases, a ratio that toner particles cover the surface of a magnetic carrier particle (a coverage of the surface of a magnetic carrier particle by toner particles) increases. Therefore, an amount of toner particles that cannot sufficiently frictionally contact the magnetic carrier increases, the toner charge amount per weight unit Q may decrease.

By contrast, as described above, even if toner is supplied to obtain a target Vtref of the output voltage from the toner concentration sensor 24, the toner concentration can fluctuate with time. The fluctuation can occur because, if the toner flowability changes due to environmental change or if a bulk toner concentration changes according to a long-term wait condition, the magnetic permeability of developer under the same toner concentration condition may change.

If a configuration in which the Vtref value is corrected based on an amount of toner adhesion to a patch pattern toner image is employed in order to stabilize a concentration in development, the correction of Vtref can fluctuate the toner concentration. And, if the toner concentration changes while the toner charge amount Q is held constant, it can be that the toner chargeability of magnetic carrier has changed. The toner chargeability means the ability to take/carry an electrical charge. By contrast, if the change of toner concentration corresponds to the change of the toner charge amount Q, it can be contemplated that the toner chargeability of magnetic carrier has not changed. Therefore, the toner chargeability of magnetic carrier cannot be ascertained only based on the toner charge amount Q.

The toner chargeability of magnetic carrier can be obtained regardless of amount of toner concentration not by using the toner charge amount per weight unit Q itself but by using an index DA that can be obtained by the following equation (hereinafter referred to as "Equation 1"):

$$DA=Q\times T/Ts \qquad \text{Equation 1,}$$

where "Q" represents a toner charge amount, "T" represents a toner concentration in developer, "Ts" represents a fresh toner concentration.

In Equation 1, the toner concentration T (unit: [wt %]) in developer indicates a toner concentration in developer when the toner charge amount Q (unit: [μC/g]) is measured. Further, the "fresh toner" means developer that is set to be contained in a new developing unit.

The fresh toner concentration Ts depends on an average particle diameter of a magnetic carrier particle to be used and/or on other image forming conditions. However, when a magnetic carrier having an average particle diameter of approximately 55μ m is used, the fresh toner concentration Ts can be approximately 5 wt %. Further, when a magnetic carrier having an average particle diameter of approximately 35μ m is used, the fresh toner concentration Ts can be approximately 7 wt %.

In each variable in Equation 1, the toner concentration T of the developer can be detected by the above-described toner concentration sensor 24. Since the fresh toner concentration Ts is a previously determined constant, and therefore is no need to be detected. By contrast, since the toner charge amount Q per weight unit is a variable, the toner charge amount Q needs to be detected to obtain the index DA. However, it is significantly difficult to detect the toner charge amount Q in the developing unit 20. Since there is no technique for easily measuring the toner charge amount Q in the developing unit 20, the toner charge amount Q is generally measured by sampling toner from the developing unit 20 and setting the sampled toner in an external measuring unit such as a suction blow-off unit.

Figure 4:
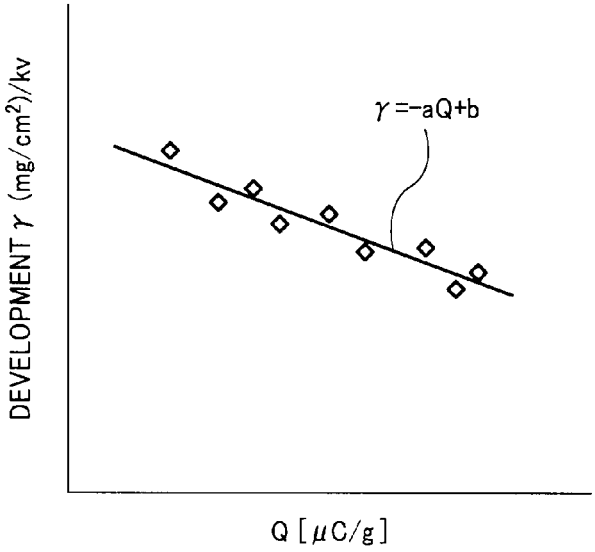
FIG. 4 is a graph showing a relation of a toner charge amount Q and a development $\gamma$.

As shown in FIG. 4, in a general range of toner charge amount Q, from 10 μC/g to 35 μC/g, regardless of the toner concentration T, it is known that the development γ satisfies a substantially linear relation with the toner charge amount Q per weight unit. The linear relation can be expressed by the following equation (hereinafter referred to as "Equation 2"):

$$\gamma=-a\times Q+b \qquad \text{Equation 2,}$$

where "a" and "b" represent constants unique to the image forming apparatus 100. The constants "a" and "b" are same when they come from an identical model of the image forming apparatus 100.

Further, the following equation expresses a modified equation based Equation 2, which is hereinafter referred to as "Equation 3":

$$Q=-(\gamma-b)/a \qquad \text{Equation 3.}$$

Further, substituting Equation 3 into Equation 1, the following equation is obtained. Hereinafter, the following equation is referred to as "Equation 4":

$$DA=-T(\gamma-b)/Ts\times a \qquad \text{Equation 4.}$$

The main controller 110 of the image forming apparatus 100 substitutes the value of the development γ obtained by the above-described image forming ability adjusting process into Equation 4 to obtain the index DA that indicates the toner chargeability of magnetic carrier.

Figure 5:
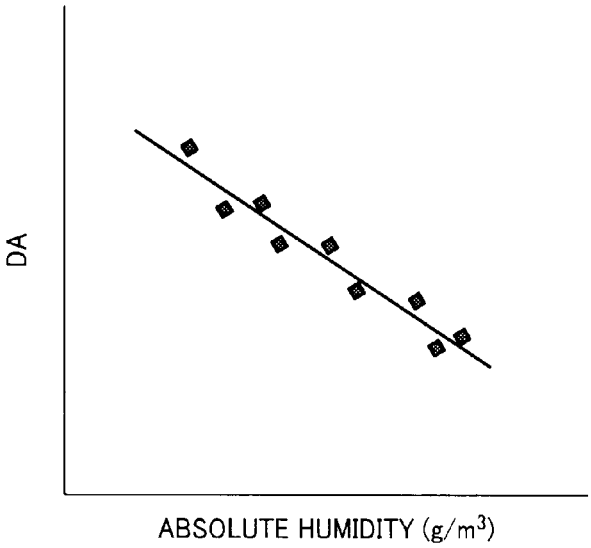
FIG. 5 is a graph showing a relation of an index DA obtained using Equation 4 and an absolute humidity.

However, the index DA obtained with Equation 4 cannot be used as is to ascertain the toner chargeability of magnetic carrier accurately because the toner chargeability of magnetic carrier may significantly vary according to humidity. Generally, as the absolute humidity increases, a molecular weight of water that mediates between a magnetic carrier particle and a toner particle also increases, which has a tendency to decrease the toner chargeability of magnetic carrier. For example, a normal value of the index DA of fresh toner obtained using Equation 4 varies linearly and inversely with the absolute humidity as shown in FIG. 5. That is, the normal value of the index DA obtained using Equation 4 varies according to the absolute humidity. Nevertheless, an error can cause if the toner chargeability of magnetic carrier is evaluated based only on the calculation results of the index DA obtained by Equation 4 without considering the absolute humidity.

It should be noted that the characteristic shown in FIG. 5 is just one example. As an alternative to the above-described characteristic, depending on types of developer, the normal value of the index DA may vary with respect to the absolute humidity at an inflection point.

In the image forming apparatus 100 of the present invention, an absolute humidity sensor 80 is disposed. The absolute humidity sensor 80 detects the absolute humidity in the image forming apparatus 100 by using a known technique. Further, through a test that uses fresh toner and a test printer that has an identical configuration to the image forming apparatus 100, an algorithm to correct the index DA calculated based on Equation 4 to a specific value under an absolute humidity condition of 10 g/m$^3$ and store in the data storage unit 120 including the RAM 120*a* and the ROM 120*b*.

Specifically, the algorithm is an equation to express a relation between the normal value of the index DA obtained using fresh toner and the test printer identical to the image forming apparatus 100 and the absolute humidity. Based on the equation, the normal value of the index DA under the absolute humidity at detection of the absolute humidity and the normal value of the index DA under a standard humidity condition are specified and compared. The ratio obtained by the comparison is multiplied by the calculation result of the index DA obtained using Equation 4, so that the index DA can be corrected to a specific value for the standard humidity condition. Then, based on the corrected index DA and a control table shown in FIG. 6, which is previously stored in the data storage unit 120, the main controller 110 can control the drive of the above-described carrier supply unit 23. Thus, new and used magnetic carriers are changed in accordance with the rate of progress of deterioration in the magnetic carriers.

With the above-described configuration, the toner chargeability of magnetic carrier is detected accurately and the magnetic carrier is supplied as needed. By so doing, waste magnetic carrier produced by supplying magnetic carrier more than needs can be avoided.

When the relation between the normal value of the index DA obtained using the fresh toner and the test printer and the absolute humidity has characteristics to curve at an intermediate inflection point, a correction table can be used as the algorithm instead of an equation.

Further, when the algorithm differs among the magenta, cyan, yellow, and black toners, it is desirable to obtain the index DA based on the respective algorithms.

Further, depending on differences of the normal values of the index DA, different correction tables such as a table shown in FIG. 6 can be used.

Exemplary Embodiment 2

Next, a description is given of an image forming apparatus according to Exemplary Embodiment 2 of the present invention.

Elements or components of the image forming apparatus according to Exemplary Embodiment 2 may be denoted by the same reference numerals as those of the image forming apparatus 100 of FIG. 2 according to Exemplary Embodiment 1 and the descriptions thereof are omitted or summarized.

The image forming apparatus 100 according to Exemplary Embodiment 2 does not include the carrier supplying units 23M, 23C, 23Y, and 23K. Further, each of the developing units 20M, 20C, 20Y, and 20K included in the image forming apparatus 100 according to Exemplary Embodiment 2 does not have an opening from which used developer may overflow. With the above-described configuration, the magnetic carrier contained in each of the developing units 20M, 20C, 20Y, and 20K may be degraded gradually.

Further, the image forming apparatus 100 according to Exemplary Embodiment 2 stores a control table as shown in FIG. 7, which is different from the control table shown in FIG. 6. According to the control table, when the index DA for each color after correction based on the absolute humidity falls within a range of from 15 to 30, the main controller 110 determines that there is not any problem and does not need to conduct a special control. By contrast, when the index DA after correction based on the absolute humidity falls in a range of from 13 to 14 or from 31 to 32, the main controller 110 views that the toner chargeability of magnetic carrier is about to increase or decrease to the limit and shows a message on a screen of a display unit, not shown, or conveys with sound to user indicating that the developer almost reaches the end of its life.

Further, when index DA after correction based on the absolute humidity is 12 or below or 33 or above, the main controller 110 views that the toner chargeability of magnetic carrier is about to increase or decrease to the limit and indicates a message on a screen of a display unit or with sound that the developer needs to be replaced.

According to the above-described configuration, while the toner chargeability of the magnetic carrier are being detected accurately, an end of life of developer or a time of end of life of developer can be detected accurately, based on detection results.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

a latent image carrier to carry a latent image on a surface thereof;

a developing unit to develop the latent image with developer including toner and carrier into a toner image;

a developer bearing member to carry the developer;

a first detector to detect an amount of toner adhesion per unit area of the toner image developed by the developing unit;

a second detector to detect humidity; and a controller to calculate an index that indicates toner chargeability of the carrier of the developer contained in the developing unit based on detection results of the amount of toner adhesion obtained by the first detector and perform a given control process based on calculation results thereof, the controller including a data storage unit to store an algorithm to correct the index to a specific value according to a specific humidity, based on detection results of the humidity obtained by the second detector, the controller correcting the index obtained based on the amount of toner adhesion based on the algorithm.

2. The image forming apparatus according to claim 1, wherein the given control process comprises discharging at least carrier contained in the developer and supplying one of new carrier and new developer from a toner supplying unit to the developing unit.

3. The image forming apparatus according to claim 1, wherein the given control process comprises informing a user that carrier needs to be supplied to the developing unit to replace used carrier with new carrier.

4. The image forming apparatus according to claim 1, wherein the developing unit comprises a third detector to detect a toner concentration of the developer contained in the developing unit, the developing unit developing the latent image formed on the latent image carrier into a visible image by adhering the toner contained in the developer carried on the surface of the developer bearing member to the latent image, the controller varying a development potential that represents a difference between a latent image potential of the latent image carrier and a potential of the developer bearing member and forming a given toner image under different development potential conditions, obtaining a slope of a line indicating a relation between the amount of toner adhesion to the respective toner images and the development potential that corresponds to respective toner images based on the amount of toner adhesion detected by the first detector and the development potential, and calculating the index based on detection results of the toner concentration obtained by the third detector and the slope of the line.

5. The image forming apparatus according to claim 4, wherein the controller calculates the index as $DA=-T(\gamma-b)/(Ts\times a)$, where DA represents a value of the index, γ represents the slope, T represents a toner image of the developer contained in the developing unit, Ts represents a fresh toner concentration that is a toner concentration of the developer contained in the developing unit when the developing unit is just replaced with a new unit, a represents a given first constant, and b represents a give second constant.

6. An image forming apparatus, comprising:

a latent image carrier to carry a latent image on a surface thereof;

a developing unit to develop the latent image with developer including toner and carrier;

a developer bearing member to carry the developer;

a first detector to detect an amount of toner adhesion per unit area with respect to a toner image developed by the developing unit;

a second detector to detect humidity; and a controller to calculate an index that indicates toner chargeability of the carrier of the developer contained in the developing unit based on detection results of the amount of toner adhesion obtained by the first detector and perform a given control process based on calculation results thereof, the controller including a data storage unit to store an algorithm that indicates a relation between the humidity and a normal value of the index, the controller specifying and determining the normal value that corresponds to the detection results of the humidity obtained by the second detector based on the algorithm stored in the data storage unit and performing the given control process based on a difference between the determination results and the calculation results of the index.

7. The image forming apparatus according to claim 6, wherein the given control process comprises discharging at least carrier contained in the developer and supplying one of new carrier and new developer from a toner supplying unit to the developing unit.

8. The image forming apparatus according to claim 6, wherein the given control process comprises informing a user that carrier needs to be supplied to the developing unit to replace used carrier with new carrier.

9. The image forming apparatus according to claim 6, wherein the developing unit comprises a third detector to detect a toner concentration of the developer contained in the developing unit, the developing unit developing the latent image formed on the latent image carrier into a visible image by adhering the toner contained in the developer carried on the surface of the developer bearing member to the latent image, the controller varying a development potential that represents a difference between a latent image potential of the latent image carrier and a potential of the developer bearing member and developing a given toner image under different development potential conditions, obtaining a slope of a line indicating a relation between the amount of toner adhesion to the respective toner images detected by the first detector and the development potential that corresponds to respective toner images based on the amount of toner adhesion detected by the first detector and the development potential, and calculating the index based on detection results of the toner concentration obtained by the third detector and the slope of the line.

10. The image forming apparatus according to claim 9, wherein the controller calculates the index as $DA=-T(\gamma-b)/(Ts\times a)$, where DA represents a value of the index, γ represents the inclination, T represents a toner image of the developer contained in the developing unit, Ts represents a fresh toner concentration that is a toner concentration of the developer contained in the developing unit when the developing unit is just replaced with a new unit, a represents a given first constant, and b represents a give second constant.

* * * * *